United States Patent [19]

Magnuson

[11] 4,217,984

[45] Aug. 19, 1980

[54] STORING AND DISPENSING BOX

[76] Inventor: Lars Magnuson, Gräfsnäs Säteri, Sollebrunn, Sweden, 46030

[21] Appl. No.: 949,213

[22] Filed: Oct. 6, 1978

[30] Foreign Application Priority Data

Nov. 8, 1977 [SE] Sweden ..... 7712577

[51] Int. Cl.[2] ..... B65D 85/672

[52] U.S. Cl. ..... 206/403; 220/4 E; 220/DIG. 25; 229/23 BT

[58] Field of Search ..... 206/389, 395, 398, 401, 206/403, 409, 412; 229/17 S, 23 BT, 23 R, 23 A; 220/4 B, 4 E, DIG. 25

[56] References Cited

U.S. PATENT DOCUMENTS

| | | | |
|---|---|---|---|
| 1,826,084 | 10/1931 | Mohr | 206/409 X |
| 3,698,548 | 10/1972 | Stenzel et.al. | 229/17 S X |
| 4,006,854 | 2/1977 | Gibson et al. | 206/409 X |
| 4,027,794 | 6/1977 | Olson | 206/403 X |

*Primary Examiner*—Stephen Marcus

*Attorney, Agent, or Firm*—Cantor and Singer

[57] ABSTRACT

A box for storing and dispensing food-stuff distributed upon a foil band and wound to a spool upon a shaft comprises two like components, each defined by a base plate and three adjoining walls. Each wall is provided with an open slot starting from the edge of the pertaining wall remote from the base plate and extending about half-way down towards the latter, whereby the two components become sufficiently deformable to permit a fitting together, to form either a closed box, or a stand presenting an open front for serving-out purposes.

The slots in two oppositely located walls are formed to carry the ends of the shaft and the slot in the intermediate wall preferably is deeper than the slots in the first mentioned walls.

A box of this type may be fitted in an apparatus having a rotatable drum for coiling up the wasted foil band, as this is pulled out of the spool, to make the food-stuff available.

1 Claim, 4 Drawing Figures

STORING AND DISPENSING BOX

BACKGROUND OF THE INVENTION

The present invention refers to a box suitable for storing and dispensing of band formed material wound to a spool upon a shaft. The invention is especially suited for the handling of sliced food-stuff arranged upon a band of plastics foil and intended as dressing for open sandwiches, but may also be used for many other purposes.

The aim of the invention is to propose an embodiment, which permits simple and cheap manufacture, which provides a satisfactory protection for the goods and which may serve as a holding means when the goods are fed out.

SUMMARY OF THE INVENTION

A box according to the invention comprises two like components, each having a base plate, a back wall and two side walls, where each side wall is provided with a slot, extending from the edge of the wall being remote from the base plate, about half-way to said base plate, being open at said edge and at its bottom being formed to carry the shaft, the back wall being provided with a slot starting from its edge remote from the base plate and extending towards the latter, at least as far as the slots in the side walls.

Two such components may be arranged to fully enclose the spoolshaped unit, and when the "cover" has been removed it may be reversed and fitted outside of the bottom portion, whereby a sturdy holder will be obtained, from which the band may be pulled out, as needed.

An apparatus adapted to dispense food-stuff from such box includes a support structure having means for receiving said box structure in a fixed position, as well as means for extracting and storing the foil band from the spool in the box. When the band is pulled out the food-stuff carried upon the band will be presented for removal.

BRIEF DESCRIPTION OF THE DRAWINGS

FIG. 1 shows two components A and B intended together to form a box suitable to receive a band of plastics foil carrying food-stuff slices adapted for dressing open sandwiches, and wound upon a shaft to a spool. A means for feeding out the dressing from this spool is shown in FIG. 2.

Figure 1:
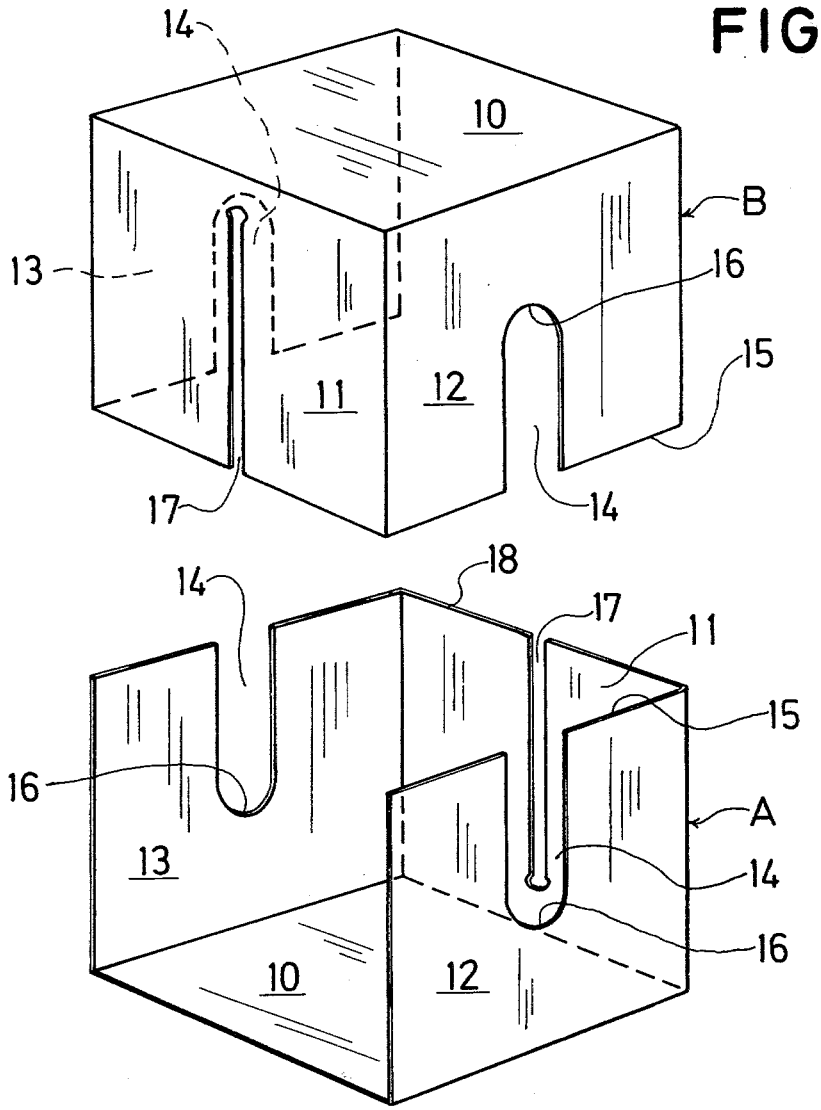
FIG. 1 shows two box components turned into the positions they will occupy in the package to be made, FIG. 2 very schematically shows a simple apparatus for feeding out sandwich dressing from a box.

The box consists of two like components which are fitted together. For the sake of simplicity one component, A, is here referred to as the bottom portion, while the other, B, is referred to as cover. As the two components are alike it is immaterial which of them forms the bottom and which forms the cover.

Each component comprises a base plate 10, a back wall 11 and two side walls 12 and 13. The latter are substantially square, having a breadth and height slightly exceeding the diameter of the expected spool.

The breadth of the base plate 10 and of the back wall 11 will slightly exceed the breadth of the band.

Each side wall 12, 13 is provided with a centrally located slot 14, which is open at the edge 15 of the wall being parallel to the base plate and extending towards the latter about half-way down the wall. The bottom 16 of the slot 14 has a semi-circular form and is suited to support a shaft 23 for the spool (vide FIG. 2). The back wall 11 is provided with a centrally located slot 17, which from the edge 18 being parallel to the base plate extends a substantial portion down the back wall.

The two components may be manufactured from surface treated cardboard, plastics or other suitable material. The slots 14 and 17 will provide, for each component sufficient resiliency to permit the "cover" B being pressed downwards, from the position shown in FIG. 1, to enclose bottom portion A. The two components will then fully surround a spool fitted into the bottom portion with the ends of its shaft resting in the bottoms 16 of the slots 14.

A box of the type described above, used for storing sliced food-stuff, may be enclosed in shrinkable plastics foil and be kept in a refrigerator until it is time to use the goods.

Food-stuff to be used as sandwich dressing is usually sliced in a machine and will then automatically be distributed over a band of plastics foil which is then wound to a spool. Such handling is well known in the art, but hitherto there has been no rational means for handling and feeding out from such spools.

A box according to the invention will in a simple manner solve the problem of handling from the packing plant to the consumer, and it will also advantageously be used as a stand during feedingout, at least with medium sized consumers.

Starting from a compressed position of the components according to FIG. 1 the cover B is lifted off and turned 180°, whereupon it may be brought once again to enclose component A. The combined components will then be closed upwardly and at the slots carrying the shaft, but will show an open front through which the band may be pulled out.

A drawback with known means for feeding out food-stuff from a plastics band is the amount of soiled band collecting in front of the spool holder. As a spool of the type intended here often contains about 20 meters of band, there may be an embarrassing amount of used band at hand before someone finds time to cut and remove the band.

One way of avoiding this collection of used band is to wind it upon a second shaft fitted upon some crank mechanism, making it possible to pull out the band from the spool and simultaneously feed out the slices from the latter.

Figure 2:
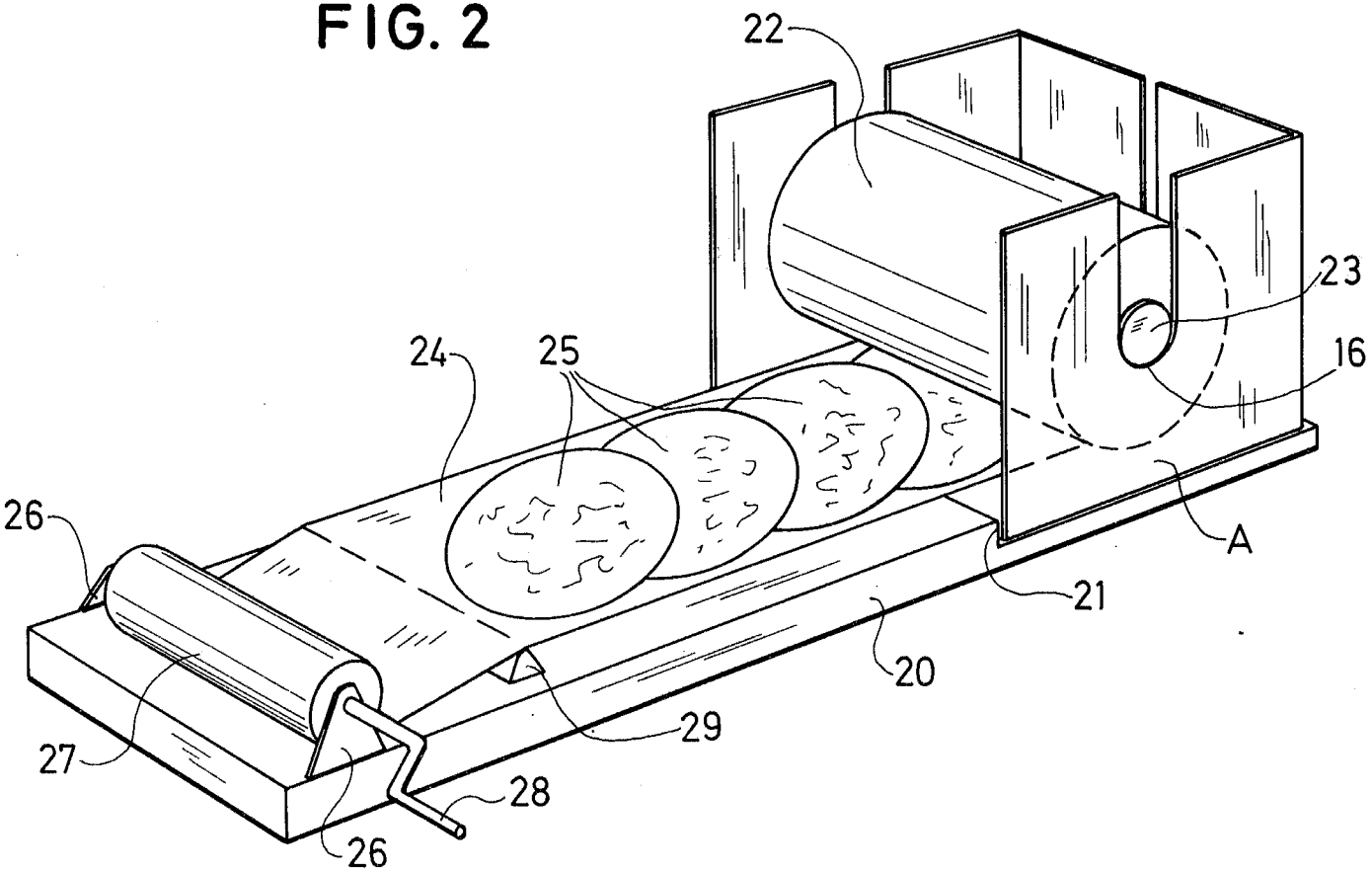

FIG. 2 shows a simple device including a plate 20 which at one end is provided with a shoulder 21 suited to support the bottom portion A of a box (possibly reinforced by a reversed cover B). Means (not shown) for locking the box to the base plate may be provided.

The box contains a spool 22 of plastics foil wound upon a shaft 23. Slices 25 of food-stuff are distributed along the band. As it is desirable to remove the slices manually from the band the slices are arranged with a certain overlapping.

Shaft 23 preferably is a length of plastics tubing having a length slightly exceeding the breadth of the base plate 10 of the box, so that ends of the shaft may extend into the slots 14 to rest in the bottom ends 16 thereof in such a manner that the shaft and thus the spool may rotate.

At the opposite end of plate 20 there are two brackets 26, upon which a second shaft 27 is fitted. Preferably a used shaft 23 is removed from a box when this is empty and transferred to the brackets. By the aid of a crank 28 it is possible to rotate shaft 27, and when the end of the band has been attached to the shaft it is possible to wind the used band upon this shaft, while simultaneously feeding out slices 25 from the spool, as desired.

Plate 20 is provided with a guide 29 which lifts band 24 at a point between box A and shaft 27, whereby a removal of the slices will be facilitated. A lid, or cover, may be provided to protect the slices closest to the spool.

These are varieties of food-stuff, such as certain types of cheese and meat-pastes, which may be processed to form a continuous strip. Such strip, of suitable breadth, may be coiled directly upon the foil band, to form the spool, but on such occasion it will be necessary to cut off pieces from the continous strip, as needed.

Figure 3:
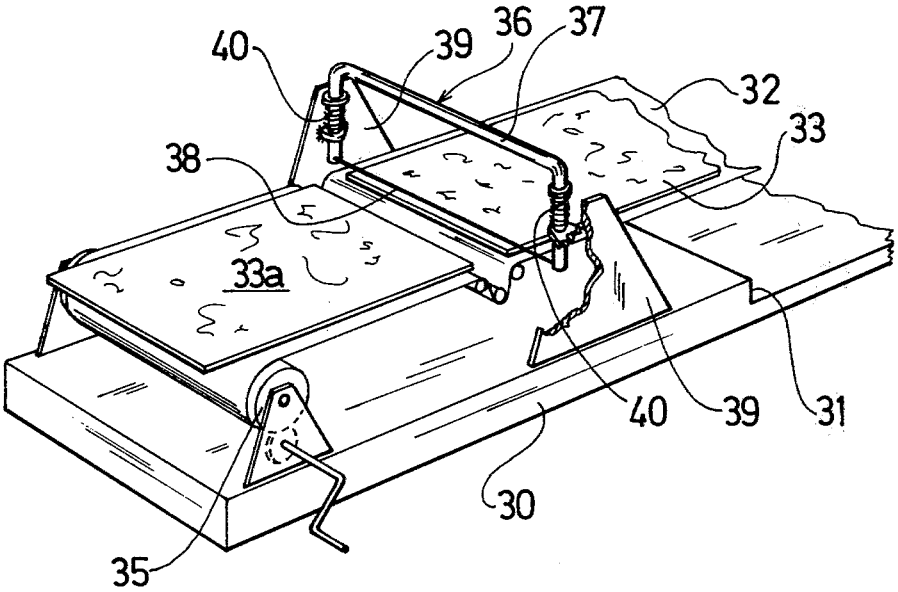
FIG. 3 shows part of a modified embodiment of the apparatus, and FIG. 4 schematically illustrates how the apparatus according to FIG. 3 work.
Figure 4:
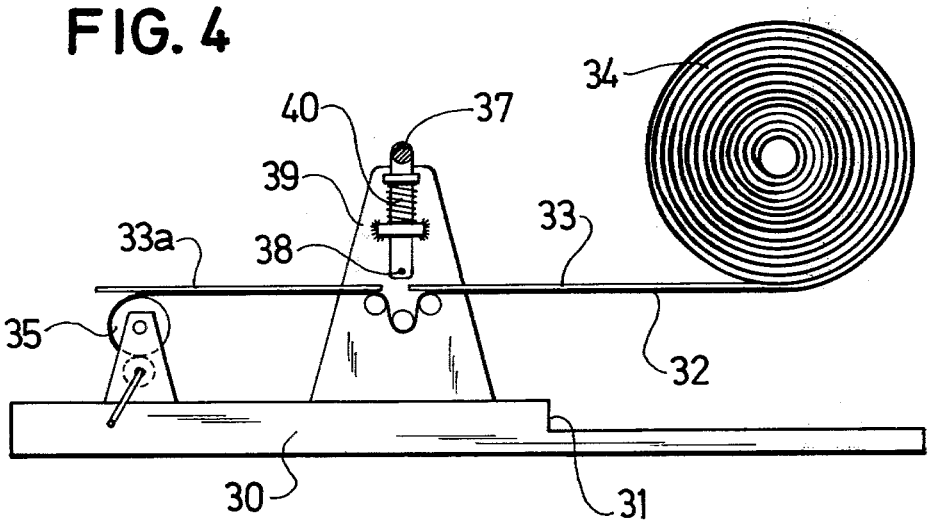

FIGS. 3 and 4 show a modified embodiment of the apparatus shown in FIG. 2, but suited to handle a continous strip of food-stuff.

A support plate 30 has a shoulder 31 for receiving the box (not shown). The foil band 32 is here covered by a continous strip 33 of processed food-stuff, such as cheese or meat-paste, coiled together with the foil band upon the spool 34.

The foil band is pulled out and coiled upon a roller 35, which is rotatable in any suitable manner. As strip 33 is continous it is necessary to cut off pieces, as needed, and to that end a reciprocable knife 36 is provided. This knife includes a reversed U-shaped frame 37 having a thin wire 38 fitted between its downwardly directed arms. The frame is carried by two brackets 39 and is biased by springs 40 to a position permitting the passage underneath wire 38 by the strip. By pressing the top bar portion of the frame downwards the wire 38 will cut the strip, and when the pressure is removed spring 40 will lift the wire free of the strip.

The pressing action is in this simple embodiment made by hand, but any cam mechanism, for instance operated from roller 35, may serve the same purpose.

In order to prevent wire 38 from cutting through the foil also, three guide rollers 40, 41, 42 are provided to make the foil band pass a U-turn recess directly below knife 36. The stroke of the frame is restricted so the wire does not reach down to the foil, when the frame is compressed. The U-turn of the foil is so narrow that the strip 33 does not sag down thereinto.

Roller 35 is mounted a distance away from knife 36, so the foil will carry a cut-off portion, 33A of suitable length to form a sandwich dressing. Rotation of the roller will bring the forward edge of the portion past the crest of the roller, so it is easy to catch the portion and lift it off and foil.

What I claim is:

1. A box, for storing and dispensing band-formed material wound to a spool upon a shaft, comprising:

(A) two identical components, each component having a base and only three walls, a back wall and two side walls, leaving an open fourth wall space, said walls being interconnected and connected to said base, each wall being defined by a top edge remote from said base and having a height slightly exceeding the diameter of said spool;

(B) a slot in each of said side walls extending from the top edge defining said side wall, about half-way towards said base, and being terminated by a bottom portion suited to carry one end of said spool shaft; and (C) a slot in said back wall starting from the top edge defining said back wall and extending toward said base at least as far as the slots in said side walls;

(D) said slots thereby imparting resiliency to said walls, whereby one of said components will fit over the other of said components;

(1) as a cover when fitted over the top of said other component with the back wall of the cover superimposed over the open fourth wall space of the other component, and (2) as a reinforcing base when fitted over said other component with the back walls of both of said components superimposed.

* * * * *